US007404876B2

(12) United States Patent
Ono et al.

(10) Patent No.: US 7,404,876 B2
(45) Date of Patent: Jul. 29, 2008

(54) HIGH-BULK, WOOD CONTAINING PRINTING PAPER

(75) Inventors: Hiroshi Ono, Tokyo (JP); Masayuki Watanabe, Tokyo (JP); Fuminari Nonomura, Tokyo (JP); Yasunori Nanri, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 578 days.

(21) Appl. No.: 10/938,432

(22) Filed: Sep. 10, 2004

(65) Prior Publication Data

US 2005/0103458 A1 May 19, 2005

(30) Foreign Application Priority Data

Nov. 14, 2003 (JP) ..... 2003-384516
Aug. 4, 2004 (JP) ..... 2004-227377

(51) Int. Cl.
*D21H 11/08* (2006.01)
*D21H 17/28* (2006.01)
*D21H 21/22* (2006.01)
*D21H 21/18* (2006.01)

(52) U.S. Cl. ..... 162/135; 162/142; 162/175

(58) Field of Classification Search ..... 162/158, 162/175, 141–142, 147, 179, 135; 428/340–341
See application file for complete search history.

(56) References Cited

U.S. PATENT DOCUMENTS 6,346,169 B1 * 2/2002 Ikeda et al. ..... 162/158
6,576,085 B2 * 6/2003 Ikeda et al. ..... 162/158
7,101,459 B2 * 9/2006 Nisogi et al. ..... 162/135
7,208,068 B2 * 4/2007 Nisogi et al. ..... 162/135
2002/0096283 A1 * 7/2002 Ikeda et al. ..... 162/164.1
2003/0068473 A1 * 4/2003 Okumura et al. ..... 428/195
2004/0040681 A1 * 3/2004 Ohashi et al. ..... 162/158
2004/0045686 A1 * 3/2004 Nisogi et al. ..... 162/135
2004/0048087 A1 * 3/2004 Kai et al. ..... 428/537.5
2004/0065423 A1 * 4/2004 Swerin et al. ..... 162/137
2004/0188047 A1 * 9/2004 Nakamura et al. ..... 162/164.6
2005/0016701 A1 * 1/2005 Nisogi et al. ..... 162/135
2005/0103458 A1 * 5/2005 Ono et al. ..... 162/135

FOREIGN PATENT DOCUMENTS

EP 806300 A2 * 11/1997
EP 902123 A2 * 3/1999
JP 2000282398 A * 10/2000
JP 2003027385 A * 1/2003
JP 2005163253 A * 6/2005
WO WO 03083211 A1 * 10/2003

* cited by examiner

*Primary Examiner*—José A Fortuna
(74) *Attorney, Agent, or Firm*—Knobbe, Martens, Olson & Bear LLP

(57) ABSTRACT

Coat a starch-based surface-paper-strengthening agent on a base paper made from a paper material that contains at least chemically processed hardwood mechanical pulp and bulk-increasing agent; where it is desirable that the hardwood mechanical pulp with a single fiber density index of 0.20 or more be blended by 10 to 60 weight-% of the total weight of pulp, with the adding amount of bulk-increasing agent adjusted to 0.1 to 1.2 weight-% and the coating amount of starch-based surface-paper-strengthening agent, to 0.3 to 3.0 $g/m^2$.

7 Claims, No Drawings

HIGH-BULK, WOOD CONTAINING PRINTING PAPER

BACKGROUND OF THE INVENTION

1. Field of the Invention

This invention relates to a high-bulk, wood containing printing paper offering high brightness, very low density, high flexibility (low stiffness), and excellent printability.

2. Description of the Related Art

High bulk (low density) is one of important qualities required by paper products of late. Responding to the growing pro-environmental sentiment, the users are demanding paper products that offer lower weight, or lower density, while maintaining sufficient thickness, in order to achieve more effective utilization of paper pulp produced from forest resource.

One traditional method for reducing paper density (increasing paper bulk) is to use high-bulk pulp. In general, wood pulp is used widely in paper production. It is known that ground pulp produced by grinding wood material using a grinder, or refiner mechanical pulp produced by refining wood material using a refiner, or yet mechanical pulp such as thermomechanical pulp, offers stiffer fibers and is therefore more effective in reducing paper density, compared with chemical pulp produced by extracting a reinforcing substance called lignin from wood fibers through chemical processing. However, today's mechanical pulp is mostly produced from softwood trees containing large amounts of lignin, which makes it difficult to produce pulp offering high brightness. A number of issues have therefore been encountered in the effort to produce a high-bulk paper offering high brightness.

Among various types of mechanical pulp, softwood thermomechanical pulp has relatively long and stiff fibers. Therefore, paper made from such pulp had poor formation and lower smoothness, and also caused ink impression problem during offset printing. Paper made from softwood thermomechanical pulp containing stiff fibers also resulted in lower foldability—a factor that affects offset printing efficiency—and made it difficult to turn pages of printed/bound books. Regarding the use of softwood thermomechanical pulp, therefore, improvement of flexibility, or reduction of flexural stiffness, of printing paper remained an issue.

To solve the above problems, the applicant filed a patent application regarding a technology used to produce from specific hardwood trees a mechanical pulp offering high bulk, high brightness and high relative scattering coefficient (Japanese Patent Application Laid-open No. 2003-27385). The applicant also filed a patent application regarding a printing paper containing hardwood mechanical pulp, which offers low density, high brightness, high opacity and excellent printability (Japanese Patent Application Laid-open No. 2003-49386). However, when what happens to the strength, printability and other properties of paper as a result of increasing paper bulk are put into overall perspective based on the use of hardwood mechanical pulp, these conventional technologies can only achieve a paper density of around 0.50 g/cm$^3$ at the lowest for printing paper fit for practical use, and therefore further increase in paper bulk (reduction of density) remained difficult.

Another known method for reducing paper density is to use a bulk-increasing agent. Known bulk-increasing agents include a bulk-increasing agent for paper containing specified alcohol and/or its polyoxyalkylene adduct (PCT International Publication No. 98/03730), nonionic surfactant (Japanese Patent Application Laid-open No. 11-200283) and bulk-increasing agent for paper consisting of polyvalent alcohol and fatty acid ester compound (Registered Japanese Patent No. 2971447), and a technology that applies these bulk-increasing agents for paper to paperboard is also disclosed (Registered Japanese Patent No. 3041294).

As for the bulk-increasing agent based on a non-surfactant, a bulk-increasing agent for paper that contains at least one type of compound selected from a cationic compound having a specified structure, amine, acid salt of amine, or amphoteric compound is disclosed (Japanese Patent Application Laid-open No. 11-269799). A bulk-increasing agent of fatty acid polyamide polyamine type is also known. Also known is a compound with a water separation degree of 4% or more that provides the effect of increasing two or more paper qualities including bulk, brightness and opacity (Registered Japanese Patent No.3283248). Additionally, a method for producing a pulp sheet is also disclosed, where the method uses a compound with a water separation degree of 4% or more that provides the effect of increasing one or more paper qualities including bulk, brightness and opacity (Japanese Patent Application Laid-open No. 2003-105685).

Efforts to increase paper bulk using these known bulk-increasing agents cannot reduce the density of obtained printing paper to levels below 0.50 g/cm$^3$ or so, which is similar to the case when hardwood mechanical pulp is used as mentioned above, and therefore ways to further reduce paper density are needed.

Even if paper bulk can be successfully reduced and a low-density paper is obtained, when offset printed such paper would cause "bleeding," or oozing out of ink onto the back face over time. This problem, which affects printing quality, became a major issue in the effort to reduce paper density.

Based on the above background, development of a high-bulk, wood containing printing paper offering high brightness, low density, high flexibility (low stiffness) and excellent printability, while also preventing bleeding, has been awaited.

SUMMARY OF THE INVENTION

The purpose of the present invention is to provide a high-bulk, wood containing printing paper that offers high brightness, very low density, high flexibility (low stiffness) and excellent printability, and also prevents bleeding.

After conducting diligent studies to solve the aforementioned problems, the inventors found that a wood containing printing paper, made from a paper material that blends mechanical pulp produced from chemically processed hardwood pulp and also contains a bulk-increasing agent, would offer very low density, excellent paper strength and printability, and sufficient fitness for practical use, and discovered that coating a starch-based surface-paper-strengthening agent would solve the bleeding problem associated with a low-density paper. These findings led to the present invention.

In the present invention, it is desirable that of the various types of hardwood mechanical pulp produced by chemical processing, those having a single fiber density of 0.91 g/cm$^3$ or less as calculated in accordance with formula (1) shown below, or those having a single fiber density index of 0.20 or more as calculated in accordance with formula (2) shown below, be blended. The blending amount of hardwood mechanical pulp in the present invention should preferably be 10 to 60 weight-% of.the total weight of pulp. The adding amount of bulk-increasing agent should preferably be 0.1 to 1.2%, or more preferably 0.5 to 1.2%, of the total bone-dry weight of pulp.

$$\text{Single fiber density}=\rho\times(1-\text{Single fiber density index}) \quad \text{Formula (1)}$$

($\rho$: Calculated by assuming the true fiber density as 1.14 g/cm$^3$)

$$\text{Single fiber density index}=\{(\text{Fiber width}-2\times\text{Wall thickness})/\text{Fiber width}\}^2 \quad \text{Formula (2)}$$

On the other hand, the coating amount of starch-based surface-paper-strengthening agent on the obtained base paper should ideally be 0.3 to 3.0 g/m$^2$, or preferably 0.5 to 2.0 g/m$^2$.

The present invention provides a remarkable benefit in that it allows for production of a high-bulk, wood containing printing paper offering high brightness, significantly low density, high flexibility (low stiffness) and excellent printability, while also preventing bleeding, by blending chemically processed hardwood mechanical pulp, adding a bulk-increasing agent, and coating a surface-starch-based paper-strengthening agent on the obtained paper.

The present invention also offers a significant advantage in terms of helping achieve effective utilization of hardwood resource, and therefore makes a great contribution to society.

DETAILED DESCRIPTION OF THE PREFERRED EMBODIMENTS

The chemically processed hardwood pulp used in the present invention may be any known refiner groundwood pulp (RGP), thermomechanical pulp (TMP), chemi-thermomechanical pulp (CTMP), alkali peroxide mechanical pulp (APMP) or alkali peroxide thermomechanical pulp (APTMP) made from hardwood, including the hardwood mechanical pulp specified in Japanese Patent Application Laid-open No. 2003-27385. Of these, use of APMP and APTMP is desired, because they can yield pulp offering high bulk, high opacity, high brightness and high strength.

When APMP is used, woodchip is impregnated with an alkali peroxide solution containing sodium hydroxide, hydrogen peroxide or sodium silicate, and then refined in atmospheric pressure. Production of APTMP involves a refining process at high temperature under pressure. After the refining process, the woodchip is held for at least 5 minutes in the alkali peroxide solution at normal or raised temperature to produce high brightness pulp.

The above APMP or APTMP should desirably be produced through steps (a) through (i) described below:

(a) Compressing woodchip at a minimum compression ratio of 4 to 1, and impregnating it with a chelate agent when the pressure is released (b) Keeping the above impregnated woodchip for at least 5 minutes at a temperature of 10 to 80° C.

(c) Compressing the above impregnated woodchip further at a minimum compression ratio of 4 to 1, and impregnating it with an alkali reagent when the pressure is released (d) Keeping the above impregnated woodchip for approx. 10 minutes to 1 hour at a temperature of 10 to 80° C.

(e) Impregnating the above processed woodchip further with an alkali peroxide and then loosening the woodchip fibers using a refiner set to a raised or atmospheric pressure to produce wood pulp (f) Keeping the above pulp for at least 5 minutes at a temperature of 50° C. or above (g) Diluting the above pulp to a concentration of 5% or less, washing it, and then again condensing to a concentration of 15% or more (h) Refining the above pulp under a raised or atmospheric pressure to obtain pulp of a desired freeness (i) Bleaching the obtained pulp to the next or higher brightness level using an oxidizing agent or reducing agent, if necessary In step (a) above, it is desirable that the chelate agent be used by 0.05 to 0.4 solid-content weight-% of the bone-dry weight of woodchip. In step (c), it is desirable that the alkali reagent be an aqueous solution containing sodium hydroxide by 0.2 to 2.0 solid-content weight-%, sodium silicate by 0.2 to 2.0 solid-content weight-%, magnesium sulfate by 0.01 to 0.2 solid-content weight-%, chelate agent by 0.05 to 0.4 solid-content weight-%, and hydrogen peroxide by 0.2 to 5 solid-content weight-%, of the bone-dry weight of woodchip.

In step (e) above, an alkali peroxide containing chelate agent is added to the bleached, softened woodchip immediately before the primary refining process, where the woodchip is loosened into pulp fibers in a refiner set to a raised or atmospheric pressure.

As for the refiner, a general fiber-loosening system is sufficient. Preferably, a single-disc refiner, conical-disc refiner, double-disc refiner or twin-disc refiner should be used to loosen fibers.

To achieve the target brightness for the high-bulk, wood containing printing paper provided by the present invention, one or more known bleaching steps may be added to further bleach the hardwood mechanical pulp if a higher brightness level is required. In this case, an oxidizing agent such as hydrogen peroxide, ozone or peracetic acid, or a reducing agent such as hydrosulfite (sodium dithionite), sodium hydrogensulfate, sodium borohydride or formamidinesulfinic acid (FAS) can be used.

Among the aforementioned types of hardwood mechanical pulp, it is desirable that those having a single fiber density of 0.91 g/cm$^3$ or less, or those having a single fiber density index of 0.20 or more, be blended. The higher the single fiber density index, the lower the single fiber density becomes.

For your reference, the single fiber density index is calculated from the fiber width and fiber wall thickness measured on a Fiber Lab. (manufactured by Kajaani).

Since fibers of 0.20 or higher single fiber density index have a low single fiber density, paper in which such pulp is blended maintains a high bulk structure and thus a lower density. Among the applicable trees, those in the Eucalyptus family, particularly Eucalyptus Globulus, Eucalyptus Grandis, Eucalyptus Urophylla, Eucalyptus Nitens and Eucalyptus Regnance, and others in the Maple family are desired.

In addition, hardwood mechanical pulp that yields a handmade paper with a density of 0.45 g/cm$^3$ or less when the paper is made in accordance with JIS P 8222: 1998 at a Canadian standard freeness (hereinafter referred to as "CSF") of 100 ml is suitable for the present invention. By using this pulp, production of high-bulk printing paper becomes possible.

The wood containing printing paper provided by the present invention can use, as its material pulp, chemical pulp (softwood bleached kraft pulp (NBKP) or unbleached kraft pulp (NUKP), hardwood bleached kraft pulp (LBKP) or hardwood unbleached kraft pulp (LUKP), etc.), softwood mechanical pulp (groundwood pulp (GP), refiner groundwood pulp (RGP), thermomechanical pulp (TMP), chemi-thermomechanical pulp (CTMP), etc.) or de-inked pulp (DIP), either alone or in any combination at desired ratios, in addition to the aforementioned hardwood mechanical pulp, to the extent not reducing the effects of the present invention.

An appropriate blending ratio of hardwood mechanical pulp to total pulp is 10 to 60 weight-%, or preferably 20 to 40 weight-% when economy and other factors are considered, although the specific blending ratio will vary depending on the single fiber density index of the hardwood mechanical pulp, target density for the resulting high-bulk, wood containing printing paper, type and amount of the bulk-increasing agent used, and the pressure in press part and the pressure in calender part of the papermachine, among others.

There are no specific limitations as to which bulk-increasing agents can be used with the present invention, as long as the agent is known.

For example, the aforementioned bulk-increasing agents specified in PCT International Publication No. 98/03730, Japanese Patent Application Laid-open No. 11-200283, Registered Japanese Patent No. 2971447, Japanese Patent Application Laid-open No. 11-269799, Registered Japanese Patent No. 3283248, Japanese Patent Application Laid-open No. 2003-105685, etc., may be used. In addition, the bulk-increasing agents specified in Japanese Patent Application Laid-open No. 2001-355197 and Japanese Patent Application No. 2003-288328, both filed by the applicant, may also be used.

The compounds that are specified in the above publications as bulk-increasing agents are as follows:

(1) Bulk-increasing agent specified in PCT International Publication No. 98/03730

A bulk-increasing agent containing at least one type of alkyl or alkenyl adduct of ethylene oxide and propylene oxide copolymer, or polyvalent-alcohol type nonionic surfactant.

(2) Bulk-increasing agent specified in Japanese Patent Application Laid-open No. 11-20028[3]

A bulk-increasing agent containing at least one type of oil-based nonionic surfactant, sugar-alcohol-based nonionic surfactant or sugar-based nonionic surfactant.

(3) Bulk-increasing agent specified in Registered Japanese Patent No. 2971447

A bulk-increasing agent comprising an ester compound with a HLB of 1 to 14 and melting point of 100° C. or below, which is selected from a polyvalent alcohol and fatty acid ester compound, or a polyvalent alcohol and fatty acid ester compound that has an oxyalkylene group having an average of over 0 mol but less than 12 mols per 1 mol of the ester compound and also having a carbon number of 2 to 4, and where the OH in 1 mol of the polyvalent alcohol is replaced by 10 to 95 equivalent-% of ester.

(4) Bulk-increasing agent specified in Japanese Patent Application Laid-open No. 11-269799

A bulk-increasing agent containing at least one type of compound selected from a cationic compound having a specified chemical structure, amine, acid salt of amine, or amphoteric compound.

(5) Bulk-increasing agent specified in Registered Japanese Patent No. 3283248

A bulk-increasing agent comprising a compound with a water separation degree of 4% or more, and which offers two or more paper quality improvement effects among standard bulk improvement of 0.02 g/cm$^3$ or more, standard brightness improvement of 0.5 point or more, and standard opacity improvement of 0.5 point or more.

(6) Bulk-increasing agent specified in Japanese Patent Application Laid-open No. 2003-105685

A bulk-increasing agent containing a compound with a water separation degree of 4% or more, being selected from a group of compounds that include: (A) organosiloxane, (B) glyceryl ether, (C) amide, (D) amine, (E) amine acid salt, (F) class 4 ammonium salt, (G) imidazole, (H) alcohol or its alkylene oxide adduct, (I) polyvalent alcohol and fatty acid ester, and (J) polyvalent alcohol and fatty acid ester that has an oxyalkylene group having an average of over 0 mol but less than 12 mols per 1 mol of the ester compound and also having a carbon number of 2 to 4.

(7) Bulk-increasing agent specified in Japanese Patent Application Laid-open No. 2001-355197

A bulk-increasing agent comprising a compound of specified structure, such as 3-distearyl aminopropyl trimethyl ammonium chloride, 3-dioleoyl aminopropyl trimethyl ammonium chloride, etc.

(8) Bulk-increasing agent specified in Japanese Patent Application No. 2003-288328

A bulk-increasing agent that has at least one type of linear fatty acid monoamide with a carbon number of 12 to 22 as its main ingredient, an average emulsion grain size of 0.3 to 20 μm as measured by the laser diffraction scattering method, and a drop in standard static friction coefficient of 20% or less.

The present invention can reduce paper density multi-folds by using the above bulk-increasing agents together with hardwood mechanical pulp.

In other words, the present invention blends chemically processed hardwood mechanical pulp having a single fiber density of 0.91 g/cm$^3$ or less, or single fiber density index of 0.20 or more, where the blending amount of such hardwood mechanical pulp is 10 to 60 weight-% of the total weight of pulp. The adding amount of bulk-increasing agent should preferably be 0.1 to 1.2%, or more preferably 0.5 to 1.2%, of the total bone-dry weight of pulp. If the amount of bulk-increasing agent is less than 0.1%, little bulk-increasing effect can be expected. On the other hand, adding a bulk-increasing agent by more than 1.2% will not result in further bulk increase. Even if a lower paper density (higher bulk) can be achieved, however, such printing paper is not fit for practical use, as explained below.

As mentioned above, while the present invention successfully increased the bulk of paper material, a new problem arose that affects printing property. Specifically, the wood containing printing paper obtained by combining hardwood mechanical pulp and bulk-increasing agent has a very low density and porous paper layer. Therefore, despite its high bulk the paper caused "bleeding," or oozing out of dye ink over time, during offset printing. As result, a measure to prevent bleeding became necessary.

To prevent bleeding, the effects of various surface-paper-strengthening agents applied were examined. The result found that coating 0.3 to 3.0 g/m$^2$, or preferably 0.5 to 2.0 g/m$^2$, of starch-based surface-paper-strengthening agent on the surface of the base paper produced from hardwood mechanical pulp and bulk-increasing agent would prevent bleeding. This finding led to the present invention.

There are no specific limitations as to which starches can be used as the starch-based surface-paper-strengthening agent, and raw starch, or processed starch such as oxidized starch, dialdehyde starch, phosphoric acid modified starch, hydroxy ethylated starch, hydroxy propylated starch, cationized starch or enzyme modified starch can be used.

As for the coating amount of starch-based surface-paper-strengthening agent, bleeding cannot be suppressed if the coating amount is less than 0.1 g/m$^2$, while the paper density will increase if the starch-based surface-paper-strengthening agent is coated to 3.0 g/m$^2$ or more.

The high-bulk, wood containing printing paper provided by the present invention can be made using a fourdrinier papermachine, gap former or hybrid former (on-top former), or other known papermachine.

Since the obtained wood containing printing paper has higher bulk, desirably the pressure in press part of the papermachine should be minimized to the extent not affecting the machine operation. The pressure in calender part should also be minimized to the extent not reducing the smoothness of the high-bulk, wood containing printing paper.

There are no limitations as to which types of machines can be used to coat starch-based surface-paper-strengthening agent, and 2-roll size press coater, gate roll coater, blade metering coater or rod metering coater can be used in the application process. Other papermaking conditions are not specified, and the pH level during the papermaking process may be in the acid, neutral or alkali range.

The high-bulk, wood containing printing paper provided by the present invention may contain a filler.

Any known filler can be used, such as white carbon, talc, kaolin, clay, heavy calcium carbonate, precipitated calcium carbonate, titanium oxide or synthetic resin filler.

If necessary, the high-bulk, wood containing printing paper provided by the present invention can also use additives applied during the papermaking process, such as aluminum sulfate, as well as various anionic, cationic, nonionic or amphoteric retention-improving agent, drainage-improving agent, paper-strengthening agent or internal sizing agent.

In addition, adding dye, fluorescent whitening agent, pH-adjusting agent, defoaming agent, pitch-control agent or slime-control agent, if necessary, will not produce any problem.

As explained above, the present invention requires a starch-based surface-paper-strengthening agent to be coated on surface to prevent bleeding. To improve surface strength and sizing property, other water-soluble polymer may also be mixed into the coating material.

As this water-soluble polymer, carboxy methyl cellulose, polyacrylic amide, polyvinyl alcohol or other materials normally used as surface treatment agents can be used alone or in any combination. In addition, a paper-strengthening agent may be added for waterproofing and improvement of surface strength, or a surface sizing agent may be added for addition of sizing property.

As explained above, the present invention achieves its intended purpose of providing a high-bulk, wood containing printing paper offering a density much lower than the practical limit of 0.50 g/cm$^3$ achieved by conventional methods, by way of blending hardwood mechanical pulp offering high bulk and brightness, adding a bulk-increasing agent during the papermaking process, and then coating a starch-based surface-paper-strengthening agent. Specifically, a high-bulk base paper of a density ranging from 0.35 to 0.50 g/cm$^3$ can be obtained. By coating a starch-based coating material on this high-bulk base paper, a high-bulk, wood containing printing paper offering high brightness, very low density, high flexibility (low stiffness) and excellent printability, and also preventing bleeding, can be produced.

Although the basis weight, ISO brightness, PPS roughness (average surface roughness of paper as measured by paper print-surf) of a high-bulk, wood containing printing paper are not specified, desirable values are 35 to 100 g/m$^2$ for basis weight, 68.0% or more for ISO brightness, and 6.0 μm or less for PPS roughness.

The high-bulk, wood containing printing paper provided by the present invention can be suitably used as a paper for making books or used in offset printing, letterpress printing or gravure printing.

EXAMPLES

Examples of the present invention are explained below. Note that the present invention is not limited to these examples. The "%" used in the text indicates the weight percentage of solid content.

The mechanical pulps, bulk-increasing agents and a surface-paper-strengthening agent used to make the samples are specified below.

The methods used to measure the respective paper qualities are also explained.

(1) Sample Mechanical Pulps

Mechanical pulp A: Hardwood Maple TMP by Tembec; single fiber density index 0.22, ISO brightness 78.3%

Mechanical pulp B: Hardwood Eucalyptus Globulus APMP by Nippon Paper Industries; single fiber density index 0.28, ISO brightness 78.5%

Mechanical pulp C: Softwood Aspen TMP by Miller Western; single fiber density index 0.18, ISO brightness 77.1%

Mechanical pulp D: Softwood Radiata BCTMP by Winston; single fiber density index 0.16, ISO brightness 76.8%

(2) Sample Bulk-Increasing Agents

Bulk-increasing agent A: KB-1 15 (pentaerythritol distearin acid ester by Kao)

Bulk-increasing agent B: KB-08W (high-grade alcohol alkyl ether adduct by Kao)

Bulk-increasing agent C: DZ-2220 (oleic acid diamide by NOF)

Bulk-increasing agent D: 3-distearyl aminopropyl trimethyl ammonium chloride (by Nippon Paper Industries)

Bulk-increasing agent E: Lauric acid amide (by Nippon Paper Industries)

Bulk-increasing agent F: Oleic acid amide (by Nippon Paper Industries)

The preparation methods for bulk-increasing agents D, E and F are explained below:

Bulk-increasing agent D: A mixture consisting of 2.61 g of distearyl amine being second-grade amine and 1.00 g of 2,3-epoxy propyl trimethyl ammonium chloride as cationizing agent was dissolved in 15 ml of isopropanol. Then, 48% NaOH aqueous solution was added to adjust the pH to 10, and the substances were chemically reacted for 6 hours at 70° C. After the reaction period, water and chloroform were added to the mixture to extract organic substance, which was then dried on anhydrous magnesium sulfate. The residue obtained after vacuum distilling the solvent was refined by alumina column chromatography to obtain 0.66 g of white, wax-like 3-distearyl amino propyl trimethyl ammonium chloride.

Bulk-increasing agent E: A mixture of 25 g of lauric acid amide, 2.5 g of fatty acid potassium as emulsifying agent, and 472.5 g of hot water heated to 95° C. was placed in a high-pressure homogenizer (by A.P.V. Gaulin Inc.) and processed for 10 minutes under a pressure of 550 kg/cm$^2$. The maximum processing temperature was approx. 120° C. After the processing in the high-pressure homogenizer, the mixture was immediately diluted with 15° C. pure water to obtain a lauric acid amide emulsion. The average grain size as measured by a laser grain-size analyzer was 0.3 μm.

Bulk-increasing agent F: A mixture of 25 g of oleic acid amide, 2.5 g of fatty acid potassium as emulsifying agent, and 472.5 g of hot water heated to 95° C. was placed in a high-pressure homogenizer (by A.P.V. Gaulin Inc.) and processed for 10 minutes under a pressure of 550 kg/cm$^2$. The maximum processing temperature was approx. 120° C. After the processing in the high-pressure homogenizer, the mixture was immediately diluted with 15° C. pure water to obtain an oleic acid amide emulsion. The average grain size as measured by a laser grain-size analyzer was 2.3 μm.

(3) Sample Surface-Paper-Strengthening Agent

Surface-paper-strengthening agent A: Oxidized starch (Mermaid M200 by Shikishima Starch)

(4) Measuring Methods for Paper Qualities

Basis weight: Measured in accordance with JIS P 8124.

Paper thickness and density: Measured in accordance with JIS P 8118.

Brightness: Measured in accordance with JIS P 8123.

Tear length: Measured in accordance with JIS P 8113.

Pure flexural stiffness: Measured in accordance with the method explained on p. 123 of "Paper Pulp Test Methods" (by Japan TAPPI).

PPS roughness: Measured in accordance with ISO 8791 and also by soft backing.

Bleed test: The sample paper was printed on using a Roland R202 press, with damping water containing 1% etching solution (by Tokyo Ink; H solution No. 8, used by Dai Nippon Printing) and an ink prepared by adding 20% of compound to Purple A by Hayashi Ink. The printed paper was kept in a dark place for 30 days, after which bleeding of ink onto the back face was visually evaluated.

The result of the above visual evaluation was rated on the following three-point scale:

O: No oozing of ink.

Δ: Slight oozing of ink.

X: Clear oozing of ink (Ink has bled).

Measuring of paper powder amount: The sample paper was printed on using an offset press (SYSTEM C-20 by Toshiba) at a damping-water film thickness of 1.1 μm, printed ink concentration of 1.15, and printing speed of 600 rpm. Chinese ink (Newsking by Toyo Ink) was used. After 60,000 copies were printed, paper powder deposited inside a 0.02-m$^2$ non-printing area of the blanket cylinder was scraped off using ethanol, filtered through a membrane filter with a pore diameter of 0.45 μm, and dried to measure the weight of paper powder.

Example 1

A pulp slurry, prepared from 5 parts of NBKP (ISO brightness 83.5%, CSF 440 ml), 70 parts of softwood RGP (ISO brightness 70.5%, CSF 90 ml) and 25 parts of mechanical pulp A (CSF 390 ml) and then adjusted to a CSF of 110 ml, was mixed with 1.6% of aluminum sulfate, 0.2% of paper-strengthening agent (EX-230 by Harima Chemicals), 1.0% of bulk-increasing agent A and 200 ppm of retention-improving agent (DR-3600 by HYMO), and then the mixture was introduced to a Duo Former FM papermachine at a speed of 550 m/min to make paper. The produced basepaper was coated with surface-paper-strengthening agent A using a gate roll coater to a coating amount of 1.2 g/m$^2$, after which it was calendered at a nip pressure of 10 kgf to obtain a high-bulk, wood containing printing paper.

Example 2

Paper was made under the same conditions as in example 1, except that bulk-increasing agent B was used instead of bulk-increasing agent A as specified in example 1.

Example 3

Paper was made under the same conditions as in example 1, except that bulk-increasing agent C was used instead of bulk-increasing agent A as specified in example 1.

Example 4

Paper was made under the same conditions as in example 1, except that bulk-increasing agent D was used instead of bulk-increasing agent A as specified in example 1.

Example 5

Paper was made under the same conditions as in example 1, except that bulk-increasing agent E was used instead of bulk-increasing agent A as specified in example 1.

Example 6

Paper was made under the same conditions as in example 1, except that bulk-increasing agent F was used instead of bulk-increasing agent A as specified in example 1.

Example 7

Paper was made under the same conditions as in example 1, except that mechanical pulp B was used instead of mechanical pulp A as specified in example 1.

Example 8

Paper was made under the same conditions as in example 3, except that 50 parts of mechanical pulp A and 45 parts of softwood RGP were blended.

Comparison Example 1

Paper was made under the same conditions as in example 1, except that the coating amount of surface-paper-strengthening agent A as specified in example 1 was changed to 0.2 g/m$^2$.

Comparison Example 2

Paper was made under the same conditions as in example 2, except that the coating amount of surface-paper-strengthening agent A as specified in example 2 was changed to 0.2 g/m$^2$.

Comparison Example 3

Paper was made under the same conditions as in example 1, except that mechanical pulp C was used instead of mechanical pulp A as specified in example 1.

Comparison Example 4

Paper was made under the same conditions as in example 1, except that mechanical pulp D was used instead of mechanical pulp A as specified in example 1.

Comparison Example 5

Paper was made under the same conditions as in example 1, except that no bulk-increasing agent was added.

Comparison Example 6

Paper was made under the same conditions as in example 7, except that no bulk-increasing agent was added.

Comparison Example 7

Paper was made under the same conditions as in comparison example 4, except that 2% of bulk-increasing agent A was added. If softwood Radiata BCTMP is blended as mechanical pulp and a bulk-increasing agent is used, increasing the amount of bulk-increasing agent to 1.0% would not reduce the density below a certain level. The density-reduction effect of this formulation is therefore limited.

Comparison Example 8

Paper was made under the same conditions as in example 1, except that 65 parts of mechanical pulp A and 30 parts of softwood RGP were blended and no bulk-increasing agent was added. Adding 65 parts of mechanical pulp A slightly reduced the density, but the surface strength was reduced and the amount of paper powder increased, resulting in lower printability.

When the results of examples 1 and 7 and comparison examples 3 and 4 are compared, it is clear that the density of the obtained wood containing printing paper cannot be reduced to 0.50 g/cm$^3$ or below using mechanical pulp with a single fiber density index of less than 0.20.

Comparison example 4 in which softwood BCTMP is blended resulted in lower brightness, higher PPS roughness and increased stiffness (higher pure flexural stiffness in the CD direction). When examples 1 through 6 and comparison example 5 are compared, it is clear that a combination of hardwood mechanical pulp and bulk-increasing agent would significantly lower the density and also reduce the pure flexural stiffness in the CD direction. From comparison example 8, it is possible to reduce the density of the obtained wood containing printing paper to 0.50 g/cm$^3$ or below by increasing the blending amount of hardwood mechanical pulp to 65%. However, it would increase the amount of paper powder and therefore the resulting paper would not be fit for practical use. On the other hand, a comparison of examples 1 and 2 and comparison examples of 1 and 2 shows that the problem of bleeding can be solved by coating a starch-based surface-paper-strengthening agent on the wood containing printing paper produced from hardwood mechanical pulp with a bulk-increasing agent added.

It will be understood by those of skill in the art that numerous and various modifications can be made without departing from the spirit of the present invention. Therefore, it should be clearly understood that the forms of the present invention are illustrative only and are not intended to limit the scope of the present invention.

TABLE 1

| | Mechanical pulp | | Bulk-increasing agent | | | | | | | | | | | Amount of |
|---|---|---|---|---|---|---|---|---|---|---|---|---|---|---|
| | Type | Blending ratio (%) | Type | Amount added | Oxidized starch | Basis weight g/m$^2$ | Paper thickness μm | Density g/cm$^3$ | Tear length km | Brightness % | PPS roughness μm | Pure flexural stiffness in CD direction μN/m$^2$/m | Bleeding | paper powder mg/100 cm$^2$ |
| Example 1 | Mechanical pulp A | 25 | Bulk-increasing agent A | 1.0 | 1.2 | 71.5 | 150 | 0.477 | 4.4 | 68.0 | 5.6 | 174 | O | 5 |
| Example 2 | Mechanical pulp A | 25 | Bulk-increasing agent B | 1.0 | 1.2 | 71.6 | 151 | 0.474 | 4.4 | 68.2 | 5.6 | 171 | O | 6 |
| Example 3 | Mechanical pulp A | 25 | Bulk-increasing agent C | 1.0 | 1.2 | 71.4 | 152 | 0.470 | 4.3 | 68.1 | 5.7 | 172 | O | 5 |
| Example 4 | Mechanical pulp A | 25 | Bulk-increasing agent D | 1.0 | 1.2 | 71.4 | 151 | 0.472 | 4.4 | 68.1 | 5.6 | 173 | O | 5 |
| Example 5 | Mechanical pulp A | 25 | Bulk-increasing agent E | 1.0 | 1.2 | 71.4 | 151 | 0.473 | 4.3 | 68.0 | 5.6 | 173 | O | 5 |
| Example 6 | Mechanical pulp A | 25 | Bulk-increasing agent F | 1.0 | 1.2 | 71.5 | 151 | 0.475 | 4.3 | 68.2 | 5.6 | 171 | O | 5 |
| Example 7 | Mechanical pulp B | 25 | Bulk-increasing agent A | 1.0 | 1.2 | 71.5 | 160 | 0.447 | 4.9 | 70.2 | 5.4 | 185 | O | 7 |
| Example 8 | Mechanical pulp A | 50 | Bulk-increasing agent C | 1.0 | 1.2 | 71.5 | 163 | 0.440 | 4.2 | 72.0 | 5.7 | 189 | O | 8 |
| Comparison example 1 | Mechanical pulp A | 25 | Bulk-increasing agent A | 1.0 | 0.2 | 71.5 | 150 | 0.477 | 4.2 | 68.1 | 5.6 | 164 | X | 54 |

TABLE 1-continued

| | Mechanical pulp | | Bulk-increasing agent | | | | | | | | | | | Amount of |
|---|---|---|---|---|---|---|---|---|---|---|---|---|---|---|
| | Type | Blending ratio (%) | Type | Amount added | Oxidized starch | Basis weight g/m$^2$ | Paper thickness μm | Density g/cm$^3$ | Tear length km | Brightness % | PPS roughness μm | Pure flexural stiffness in CD direction μN/m$^2$/m | Bleeding | paper powder mg/100 cm$^2$ |
| Comparison example 2 | Mechanical pulp A | 25 | Bulk-increasing agent B | 1.0 | 0.2 | 71.5 | 151 | 0.474 | 4.2 | 68.0 | 5.7 | 165 | X | 49 |
| Comparison example 3 | Mechanical pulp C | 25 | Bulk-increasing agent A | 1.0 | 1.2 | 71.6 | 142 | 0.504 | 4.7 | 68.4 | 5.8 | 172 | O | 5 |
| Comparison example 4 | Mechanical pulp D | 25 | Bulk-increasing agent A | 1.0 | 1.2 | 71.5 | 141 | 0.507 | 4.8 | 67.7 | 8.1 | 235 | O | 6 |
| Comparison example 5 | Mechanical pulp A | 25 | Not added. | | 1.2 | 71.5 | 142 | 0.504 | 4.6 | 68.1 | 5.6 | 201 | O | 4 |
| Comparison example 6 | Mechanical pulp B | 25 | Not added. | | 1.2 | 71.5 | 135 | 0.530 | 4.9 | 67.5 | 8.1 | 241 | O | 4 |
| Comparison example 7 | Mechanical pulp D | 25 | Bulk-increasing agent A | 2.0 | 1.2 | 71.5 | 143 | 0.500 | 4.0 | 67.9 | 8.1 | 201 | O | 32 |
| Comparison example 8 | Mechanical pulp A | 65 | Not added. | | 1.2 | 71.5 | 135 | 0.530 | 3.9 | 72.5 | 5.9 | 168 | O | 35 |

What is claimed is:

1. A high-bulk, wood-containing calendered printing paper having a density of 0.35 to 0.50 g/cm$^3$, comprising:

a base paper comprising at least a bulk-increasing agent and one or more of hardwood mechanical pulp selected from refiner groundwood pulp, thermomechanical pulp, chemi-thermomechanical pulp, alkali peroxide mechanical pulp, or alkali peroxide thermomechanical pulp, wherein the hardwood mechanical pulp is included in an amount of 10% to 60% by weight of the pulp contained in the base paper, wherein the bulk-increasing agent is contained in an amount of 0.1% to 1.2% as solid by weight of the total bone-dry weight of pulp contained in the base paper; and a starch-based surface-paper-strengthening agent coated on a surface of the base paper in an amount of 0.3 g/m$^2$to 3.0 g/m2.

2. The high-bulk, wood-containing printing paper as described in claim 1, wherein the starch-based surface-paper-strengthening agent is raw starch or processed starch.

3. The high-bulk, wood-containing printing paper as described in claim 2, wherein the processed starch is selected from the group consisting of oxidized starch, dialdehyde starch, phosphoric acid modified starch, hydroxy ethylated starch, hydroxy propylated starch, cationized starch, and enzyme modified starch.

4. The high-bulk, wood-containing printing paper as described in claim 1, wherein the hardwood mechanical pulp has a single fiber density index of 0.20 or more.

5. The high-bulk, wood containing printing paper as described in claim 1, which has a basis weight of about 35 g/m$^2$ to about 100 g/m$^2$, an ISO brightness of about 68.0% or more, and a PPS roughness of about 6.0 μm or less.

6. The high-bulk, wood containing printing paper as described in claim 1, wherein a starch-based surface-paper-strengthening agent coated on a surface of the base paper in an amount of 0.5 g/m$^2$ to 2.0 g/m$^2$.

7. The high-bulk, wood containing printing paper as described in claim 1, wherein the bulk-increasing agent is contained in an amount of 0.5% to 1.2% as solid by weight of the total bone-dry weight of pulp contained in the base paper.

* * * * *